US011800904B2

(12) United States Patent
Spence

(10) Patent No.: US 11,800,904 B2
(45) Date of Patent: Oct. 31, 2023

(54) NECK PROTECTOR ATTACHMENT SYSTEM, NECK PROTECTOR AND PROTECTIVE FACE MASK INCORPORATING SAME

(71) Applicant: Daniel Spence, Orillia (CA)

(72) Inventor: Daniel Spence, Orillia (CA)

( * ) Notice: Subject to any disclaimer, the term of this patent is extended or adjusted under 35 U.S.C. 154(b) by 125 days.

(21) Appl. No.: 17/557,163

(22) Filed: Dec. 21, 2021

(65) Prior Publication Data

US 2022/0192286 A1 Jun. 23, 2022

Related U.S. Application Data

(60) Provisional application No. 63/128,214, filed on Dec. 21, 2020.

(51) Int. Cl.
*A42B 3/10* (2006.01)
*A41D 13/05* (2006.01)

(52) U.S. Cl.
CPC ..... *A41D 13/0512* (2013.01)

(58) Field of Classification Search
CPC A41D 13/0512; A41D 13/0556; A42B 3/105; A42B 3/04
See application file for complete search history.

(56) References Cited

U.S. PATENT DOCUMENTS 1,872,877 A * 8/1932 Bowers ..... A62B 18/04 128/201.15
3,825,952 A * 7/1974 Pershing ..... A42B 3/105 2/205
4,697,289 A * 10/1987 Luigi ..... A42B 3/105 2/205
6,163,891 A * 12/2000 Viitalahti ..... A42B 3/105 2/468
6,862,749 B1 * 3/2005 Krause ..... A42B 3/105 2/909
6,874,170 B1 * 4/2005 Aaron ..... A42B 3/0473 2/468
8,555,418 B2 * 10/2013 Singh ..... A42B 1/0186 2/173
8,950,012 B2 * 2/2015 Ilges ..... A42B 1/06 2/9
9,021,617 B2 * 5/2015 Asta ..... A42B 3/105 2/205
9,320,310 B1 * 4/2016 Judge ..... A42B 3/105
2016/0095361 A1 * 4/2016 Carmack ..... A63B 71/08 2/462
2016/0338440 A1 * 11/2016 Popejoy ..... A42B 3/121
2017/0303620 A1 * 10/2017 Sicking ..... A63B 71/10

FOREIGN PATENT DOCUMENTS

CA 2822642 A1 * 2/2014 ..... A42B 3/0473

* cited by examiner

*Primary Examiner* — Tajash D Patel
(74) *Attorney, Agent, or Firm* — Manelli Selter PLLC; Edward Stemberger

(57) ABSTRACT

An attachment system is provided for attaching a neck protector to a face mask. The attachment system includes a cord and a connector where the connector comprises a first portion and a second portion with corresponding engaging elements and a throughbore defined through each of the first portion and the second portion for receiving the cord. Kits for attaching a neck protector to a face mask are also provided where the kits include one or both of the neck protector and face mask together with the attachment system.

18 Claims, 3 Drawing Sheets

NECK PROTECTOR ATTACHMENT SYSTEM, NECK PROTECTOR AND PROTECTIVE FACE MASK INCORPORATING SAME

FIELD

This specification relates to neck protectors for use with protective face masks such as are typically used in sports, and in particular to neck protector attachment systems and neck protectors and face masks incorporating same.

BACKGROUND

The following background discussion is not an admission that anything discussed below is citable as prior art or common general knowledge. The documents listed below are incorporated herein in their entirety by this reference to them.

Protective face masks may be used for a variety of purposes including the protection of athletes in sports such as hockey, lacrosse and baseball. Such protective face masks typically include a helmet portion and backplate for protecting a user's head as well as a face portion for protecting a user's face.

It is known to combine a rigid acrylic neck protector (also known as a dangler) with such protective face masks to protect the front and sides of the user's neck. The neck protectors are typically attached with a piece of cord (such as a shoe lace or skate lace) that extends through apertures in the face mask and neck protector and tied to a desired length to allow the neck protector to move relative to the face mask while remaining in position to protect the user's neck.

A problem with this form of attachment is that it can be difficult, especially for someone with limited experience or knowledge, to make small adjustments to the length of the cord to properly attach or adjust the neck protector or to quickly change to another neck protector should one become damaged. This is particularly problematic when the knot in the cord becomes so tight during use that it may not be easily or quickly undone (especially in a cold arena and/or with cold hands). Another problem with this form of attachment is that the cords may become frayed or cut during use. These and other problems relating to time, safety, consistency and reliability of the attachments tend to deter players from using neck protectors which exposes them to greater risk of serious injury.

There is a need for an improved attachment system for neck protectors to overcome one or more of the above problems.

SUMMARY

In one aspect the invention provides a system for attaching a neck protector to a face mask comprising:

a cord having a first end and a second end;

a connector having a first portion and a second portion with corresponding engaging elements for connecting said first portion to said second portion, said first portion and said second portion each having a throughbore with a first diameter and a second diameter, where said second diameter is smaller than said first diameter and where said second diameter is larger than a cross section of said cord; and wherein one end of said cord is adapted to be disposed through openings in the neck protector and the face mask and then disposed through said throughbore of said first portion of said connector and secured to said connector at a desire length of said cord and a second end of said cord is adapted to be disposed through said throughbore of said second portion of said connector and secured to said connector at a desire length of said cord.

In another aspect, the invention provides a neck protector kit for use with a face mask, said kit comprising:

a neck protector having a plurality of openings; and a plurality of attachment systems, each comprising a cord having a first end and a second end; and a connector having a first portion and a second portion with corresponding engaging elements for connecting said first portion to said second portion, said first portion and said second portion each having a throughbore with a first diameter and a second diameter, where said second diameter is smaller than said first diameter and where said second diameter is larger than a cross section of said cord;

wherein, for each of said plurality of attachment systems, one end of said cord is adapted to be disposed through one of said openings in the neck protector and through a corresponding opening on the face mask and then disposed through said throughbore of said first portion of said connector and secured to said connector at a desire length of said cord and a second end of said cord is adapted to be disposed through said throughbore of said second portion of said connector and secured to said connector at a desire length of said cord.

In another aspect, the invention provides a face mask and neck protector kit, said kit comprising:

a face mask having a plurality of attachment points;

a neck protector having a plurality of openings; and a plurality of attachment systems for connecting said neck protector to said face mask, each of said attachment systems comprising a cord having a first end and a second end;

a connector having a first portion and a second portion with corresponding engaging elements for connecting said first portion to said second portion, said first portion and said second portion each having a throughbore with a first diameter and a second diameter, where said second diameter is smaller than said first diameter and where said second diameter is larger than a cross section of said cord; and wherein, for each of said plurality of attachment systems, said cord is adapted to be disposed through one of said plurality of openings in the neck protector and through a corresponding one of said plurality of attachment points on the face mask, then one end of said cord is adapted to be disposed through said throughbore of said first portion of said connector and secured to said connector at a desired length of said cord and a second end of said cord is adapted to be disposed through said throughbore of said second portion of said connector and secured to said connector at a desire length of said cord; and then said first portion and said second portion of said connector are engaged with said engaging elements for securing said neck protector to said face mask.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

DESCRIPTION OF VARIOUS EMBODIMENTS

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

Figure 1:
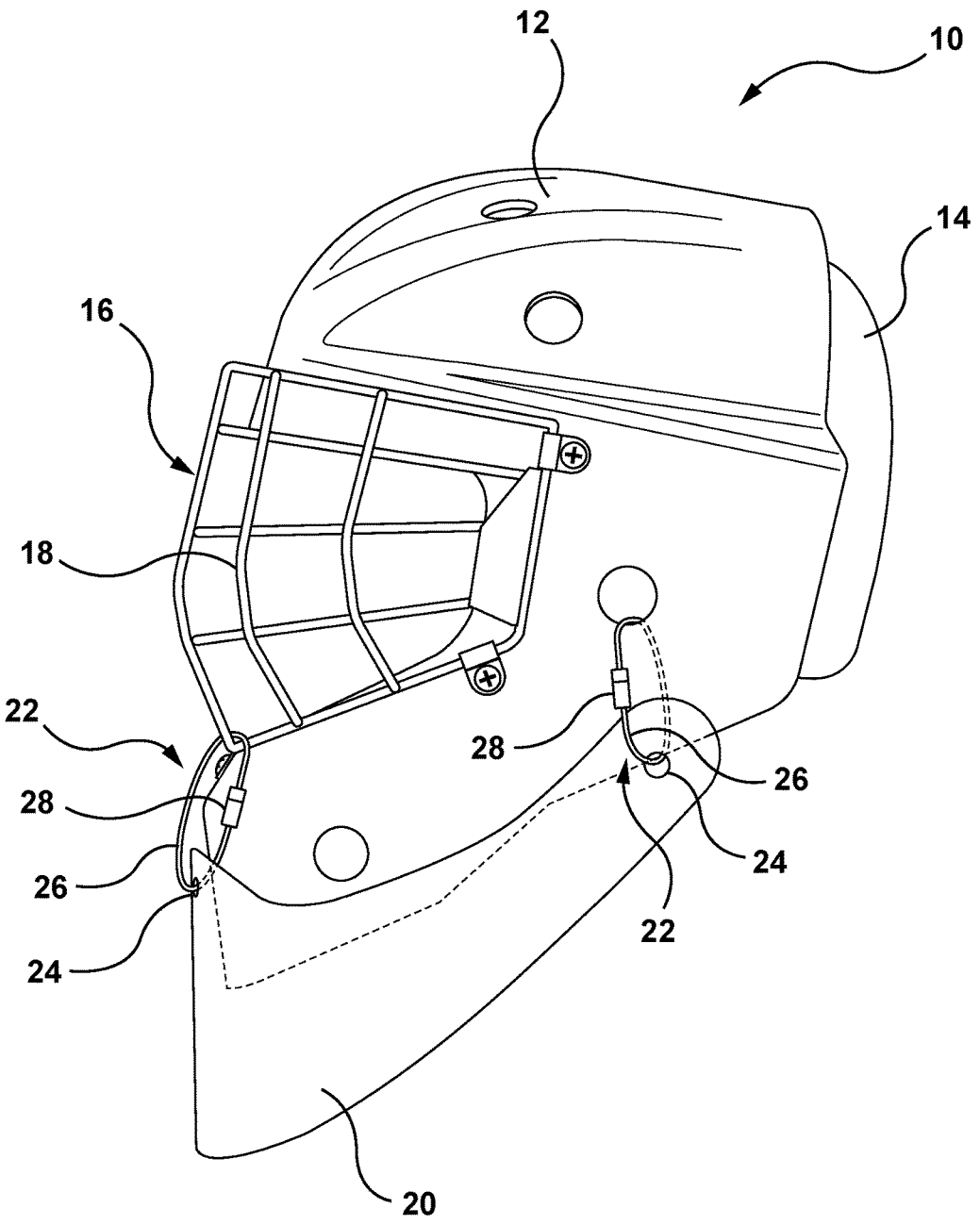
FIG. 1 is a side view of a neck protector attached to a face mask using an attachment system in accordance with the present invention.

A protective face mask is shown generally at 10 in FIG. 1. Mask 10 as shown is intended for use in ice hockey however other forms of mask 10 adapted for other sports or other non-sport applications may be utilized with the invention as well.

Mask 10 includes a helmet portion 12 and a backplate 14. A face portion 16 is located at the front of mask 10 to protect the user's face while allowing the user to see. Face portion 16 is typically covered with a wire or plexiglass screen 18 to protect the face of the user.

A neck protector 20 is shown attached to the bottom portion of mask 10 in FIG. 1 using an attachment system 22 in accordance with the present invention. Neck protector 20 is typically made from an acrylic material that is sufficiently rigid and durable to protect the neck of the user. A number of openings 24 are defined in the side and middle regions of neck protector 20 for use with attachment system 22.

Figure 2:
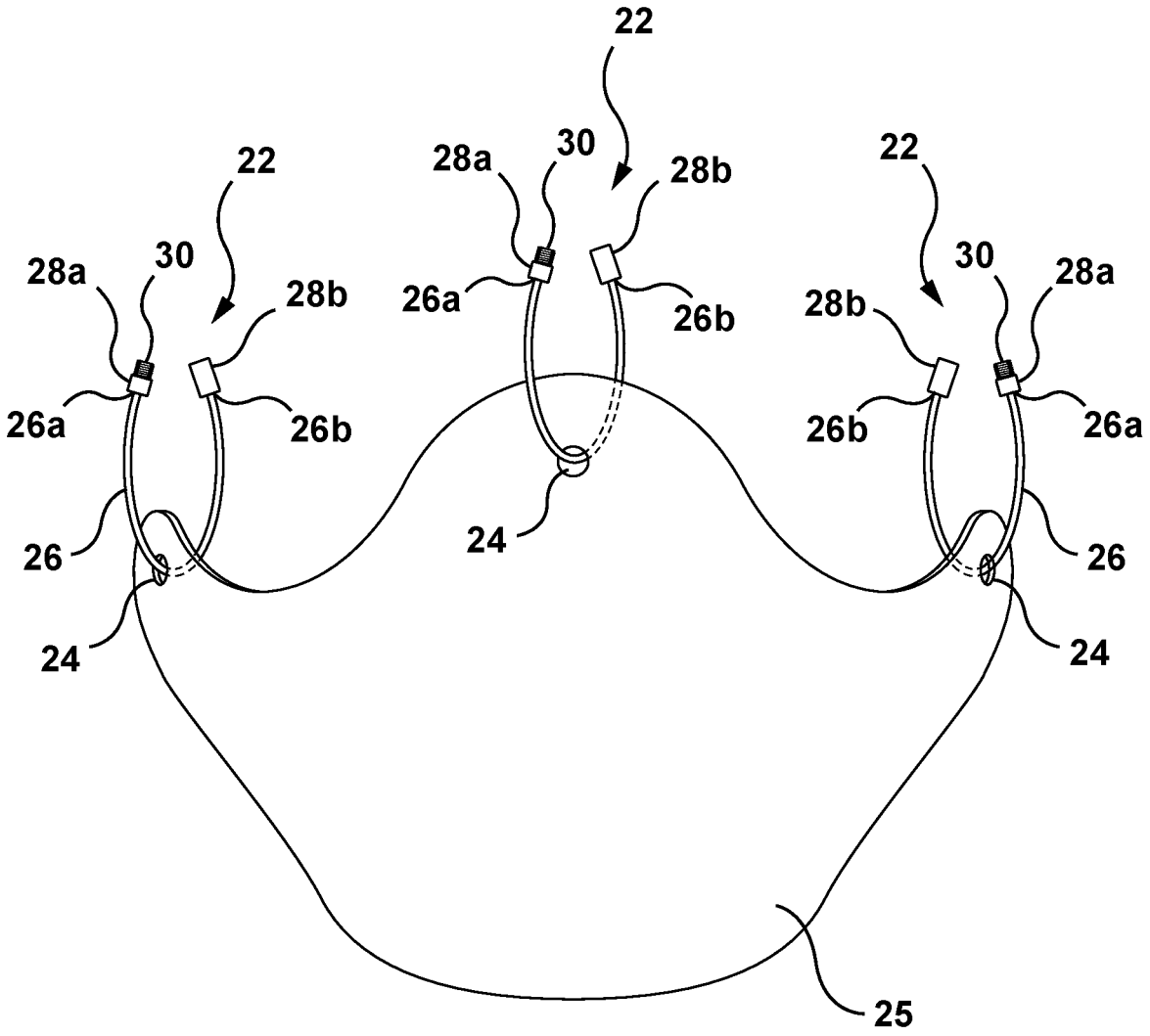
FIG. 2 is a front view of the neck protector and attachment system of FIG. 1.
Figure 3:
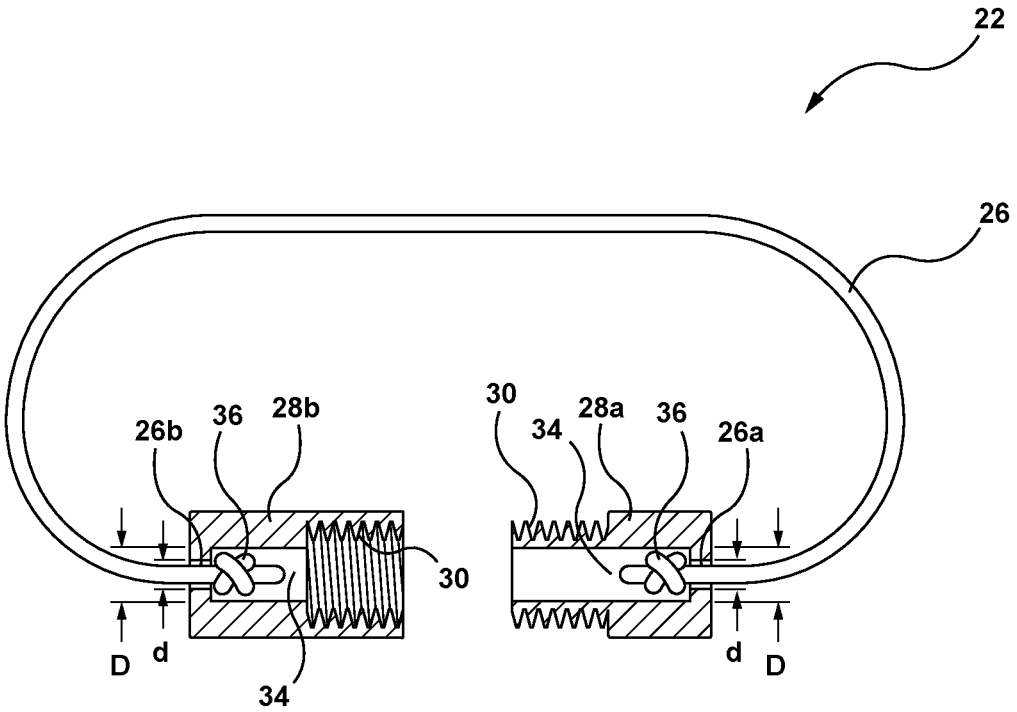
FIG. 3 is a sectional view of the attachment system of FIG. 1 in a detached position.

As seen more clearly in FIGS. 2 and 3, attachment system 22 includes a cord 26 and a connector 28. Cord 26 is preferably made from a relatively thin, durable material such as Kevlar string. Cord 26 includes a first end 26*a* and a second end 26*b*. Connector 28 includes a first portion 28*a* and a second portion 28*b* that are adapted to releasably engage one another by means of engaging elements 30 such as threads (as shown) or a snap fit joint or other suitable mechanisms.

A throughbore 34 having a first diameter D and a second diameter d (narrower than first diameter D) is provided for attaching the respective portions 28*a*, 28*b* of connector 28 to cord 26. Cord 26 includes an end piece 36 for holding cord 26 in place at a desired length within connector 28. End piece 36 is sized to fit within first diameter D of throughbore 34 while being larger than second diameter d of throughbore 34 within each of portions 28*a* and 28*b* of connector 28. End piece 36 may comprise a knot formed in cord 26 or a clamp adapted to releasably engage cord 26 at a desired location.

During use, cord 26 of attachment system 22 extends through corresponding openings 24 defined in neck protector 20 and attachment points 40 defined on mask 10. Attachment points 40 on mask 10 may differ depending on the style of mask but may include vent holes defined in the ear region of mask 10 and openings defined in screen 18 of face portion 16. Once cord 26 is extended through a corresponding opening 24 of neck protector 20 and an attachment point 40 of mask 10, first end 26*a* and second end 26*b* may be extended respectively through throughbores 34 of male portion 28*a* and female portion 28*b* of connector 28 and secured with end piece 36 at a desired length. Engagement elements 30 on male portion 28*a* and female portion 28*b* of connector 28 may then be connected together to attach neck protector to face mask.

While the above description provides examples of one or more processes or apparatuses, it will be appreciated that other processes or apparatuses may be within the scope of the accompanying claims.

I claim:

1. A system for attaching a neck protector to a face mask comprising:

a) a cord having a first end and a second end;

b) a connector having a first portion and a second portion with corresponding engaging elements for connecting said first portion to said second portion, said first portion and said second portion each having a throughbore with a first diameter and a second diameter, where said second diameter is smaller than said first diameter and where said second diameter is larger than a cross section of said cord; and c) wherein one end of said cord is adapted to be disposed through openings in the neck protector and the face mask and then disposed through said throughbore of said first portion of said connector and secured to said connector at a desire length of said cord and a second end of said cord is adapted to be disposed through said throughbore of said second portion of said connector and secured to said connector at a desire length of said cord.

2. A system as claimed in claim 1 further comprising at least one end piece adapted for releasably engaging said cord at said first end and said second end, said end piece being smaller than said first diameter D and larger than said second diameter d.

3. A system as claimed in claim 2 wherein said at least one end piece comprises a clamp.

4. A system as claimed in claim 2 wherein said at least one end piece comprises a knot in said cord.

5. A system as claimed in claim 1 wherein said engaging elements comprise corresponding male and female threads.

6. A system as claimed in claim 1 wherein said engaging elements comprise a snap fit joint.

7. A neck protector kit for use with a face mask, said kit comprising a) a neck protector having a plurality of openings; and b) a plurality of attachment systems each comprising i) a cord having a first end and a second end;

ii) a connector having a first portion and a second portion with corresponding engaging elements for connecting said first portion to said second portion, said first portion and said second portion each having a throughbore with a first diameter and a second diameter, where said second diameter is smaller than said first diameter and where said second diameter is larger than a cross section of said cord; and c) wherein, for each of said plurality of attachment systems, one end of said cord is adapted to be disposed through one of said openings in the neck protector and through a corresponding opening on the face mask and then disposed through said throughbore of said first portion of said connector and secured to said connector at a desire length of said cord and a second end of said cord is adapted to be disposed through said throughbore of said second portion of said connector and secured to said connector at a desire length of said cord.

8. A kit as claimed in claim 7 further comprising at least one end piece adapted for releasably engaging said cord at said first end and said second end, said end piece being smaller than said first diameter D and larger than said second diameter d.

9. A kit as claimed in claim 8 wherein said at least one end piece comprises a clamp.

10. A kit as claimed in claim 8 wherein said at least one end piece comprises a knot in said cord.

11. A kit as claimed in claim 7 wherein said engaging elements comprise corresponding male and female threads.

12. A kit as claimed in claim 7 wherein said engaging elements comprise a snap fit joint.

13. A face mask and neck protector kit, said kit comprising:

a) a face mask having a plurality of attachment points;

b) a neck protector having a plurality of openings; and c) a plurality of attachment systems for connecting said neck protector to said face mask, each of said attachment systems comprising i) a cord having a first end and a second end;

ii) a connector having a first portion and a second portion with corresponding engaging elements for connecting said first portion to said second portion, said first portion and said second portion each having a throughbore with a first diameter and a second diameter, where said second diameter is smaller than said first diameter and where said second diameter is larger than a cross section of said cord; and d) wherein, for each of said plurality of attachment systems, i) said cord is adapted to be disposed through one of said plurality of openings in the neck protector and through a corresponding one of said plurality of attachment points on the face mask, ii) then one end of said cord is adapted to be disposed through said throughbore of said first portion of said connector and secured to said connector at a desired length of said cord and a second end of said cord is adapted to be disposed through said throughbore of said second portion of said connector and secured to said connector at a desire length of said cord; and iii) then said first portion and said second portion of said connector are engaged with said engaging elements for securing said neck protector to said face mask.

14. A kit as claimed in claim 13 further comprising at least one end piece adapted for releasably engaging said cord at said first end and said second end, said end piece being smaller than said first diameter D and larger than said second diameter d.

15. A kit as claimed in claim 14 wherein said at least one end piece comprises a clamp.

16. A kit as claimed in claim 14 wherein said at least one end piece comprises a knot in said cord.

17. A kit as claimed in claim 13 wherein said engaging elements comprise corresponding male and female threads.

18. A kit as claimed in claim 13 wherein said engaging elements comprise a snap fit joint.

* * * * *